US005340260A

United States Patent [19]

Turra et al.

[11] Patent Number: 5,340,260

[45] Date of Patent: Aug. 23, 1994

[54] TROLLEY FOR LOADING ROLLS IN A DEVICE FOR FEEDING A PACKAGING MACHINE

[75] Inventors: Mario Turra, Casalecchio di Reno; Armando Neri, Bologna, both of Italy

[73] Assignee: G.D. S.p.A., Bologna, Italy

[21] Appl. No.: 990,489

[22] Filed: Dec. 14, 1992

[30] Foreign Application Priority Data

Dec. 20, 1991 [IT] Italy ..... B091A000482

[51] Int. Cl.[5] ..... B65H 67/00

[52] U.S. Cl. ..... 414/27; 414/401; 414/528; 414/911

[58] Field of Search ..... 414/27, 222, 278, 284, 414/331, 349, 351–353, 389, 393, 396, 401–402, 910–911, 528; 198/809, 836.1; 193/37

[56] References Cited

U.S. PATENT DOCUMENTS

| | | | |
|---|---|---|---|
| 3,195,444 | 7/1965 | McLean | 414/27 X |
| 3,206,008 | 9/1965 | Bowman et al. | 198/809 X |
| 3,443,674 | 5/1969 | Kornylak | 193/37 |
| 3,650,376 | 3/1972 | Burgis et al. | 198/809 X |
| 4,039,092 | 8/1977 | Schär | 414/401 X |
| 4,143,774 | 3/1979 | Poulsen | 414/911 X |
| 4,149,626 | 4/1979 | Holt | 198/809 X |
| 4,279,559 | 7/1981 | Stumpf | 193/37 X |
| 4,286,911 | 9/1981 | Benjamin | 414/284 X |
| 4,298,303 | 11/1981 | Ritschel | 414/401 |
| 4,306,826 | 12/1981 | Detwiler | 414/27 |
| 4,367,059 | 1/1983 | Stubbins | 414/911 X |
| 4,456,417 | 6/1984 | Gerding | 414/27 X |
| 4,555,215 | 11/1985 | Raasch et al. | 414/331 X |
| 4,566,838 | 1/1986 | Binning et al. | 414/278 |
| 4,589,811 | 5/1986 | Riccardo et al. | 414/27 X |
| 4,682,929 | 7/1987 | Kataoka | 414/911 X |
| 4,697,974 | 10/1987 | Eltoukhy | 414/331 |
| 4,810,155 | 3/1989 | D'Agnola | 414/401 X |
| 4,887,937 | 12/1989 | Thunnissen | 198/809 X |
| 5,104,281 | 4/1992 | Corvi | 198/809 X |
| 5,224,812 | 7/1993 | Oslin et al. | 414/331 |

*Primary Examiner*—Michael S. Huppert
*Assistant Examiner*—James Keenan
*Attorney, Agent, or Firm*—Guido Modiano; Albert Josif; Daniel O'Byrne

[57] ABSTRACT

Trolley for loading rolls in a device for feeding a packaging machine, which comprises a device for supporting a row of rolls arranged mutually side by side, a conveyor for transferring the row of rolls along a direction which is axial with respect to the rolls themselves, and centering and locking longitudinal rods which are suitable to be coupled, during loading, to complementarily shaped seats which are correspondingly rigidly coupled to the feeder device.

24 Claims, 1 Drawing Sheet

TROLLEY FOR LOADING ROLLS IN A DEVICE FOR FEEDING A PACKAGING MACHINE

BACKGROUND OF THE INVENTION

The present invention relates to a trolley for loading rolls of band-like material in a device for feeding a packaging machine.

In particular, the present invention relates to a trolley used to load a row of rolls of wrapping material into the device for feeding the reserve magazine of a machine which uses said band-like material to wrap or package.

It is known, in the field of automatic machines of the above described type, to use magazines which can support a plurality of rolls of band-like material and automatically feed them to a subsequent processing station.

The rolls are usually arranged in series, side by side and mutually coaxial, so as to form a continuous row; adapted transfer means remove a roll from the magazine when the used roll ends. This allows to make the packaging machine self-sufficient for relatively long periods.

A device for feeding the magazine of said packaging machines is described in Italian patent application No. 3461 A/90 and provides fixed means for the static support of a row of rolls and means for lifting and moving forward said row of rolls; said means can be actuated along a closed path defined by four successive positions, respectively an idle position, a roll lifting position, a roll transfer position and a roll release position.

The problem thus arises of periodically loading a row of rolls onto said device for feeding the magazine of packaging machines.

Conventional trolleys, on which the rolls to be loaded are arranged side by side in a row, are currently used for this purpose. However, since said trolleys entail manual interventions, they do not allow to easily transfer the row of rolls onto said feeder device.

SUMMARY OF THE INVENTION

The aim of the present invention is to provide a trolley which can automatically load a row of rolls in a device for feeding a packaging machine.

A further object of the present invention is to provide a trolley which is simple in concept, safely reliable in operation and versatile in use.

According to the present invention, a trolley for the loading of rolls in a device for feeding a packaging machine is provided which is characterized in that it comprises means for supporting a row of rolls arranged side by side, means for transferring said row of rolls along a direction which is axial with respect to said rolls, and centering and locking means which are adapted to be coupled, during loading, to complementary means which are correspondingly rigidly coupled to said feeder device.

BRIEF DESCRIPTION OF THE DRAWINGS

The characteristics and advantages of the trolley according to the invention will become apparent from the detailed description of a preferred embodiment thereof, illustrated only by way of non-limitative example, wherein.

DESCRIPTION OF THE PREFERRED EMBODIMENTS

Figure 1:
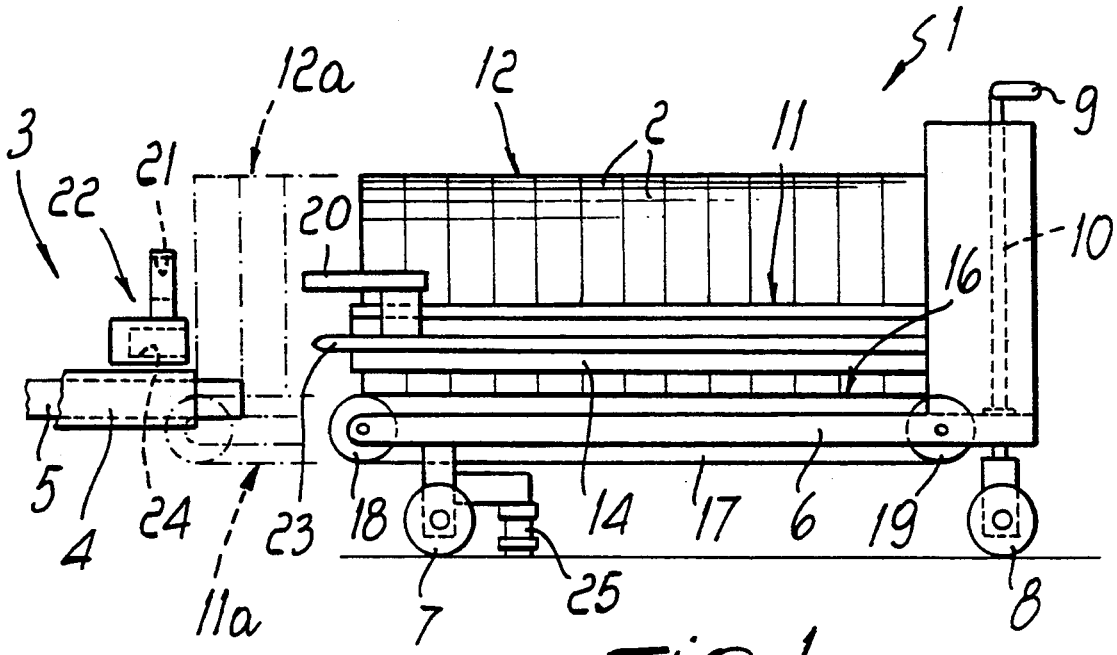
FIG. 1 is a side view of the trolley according to the present invention.
Figure 2:
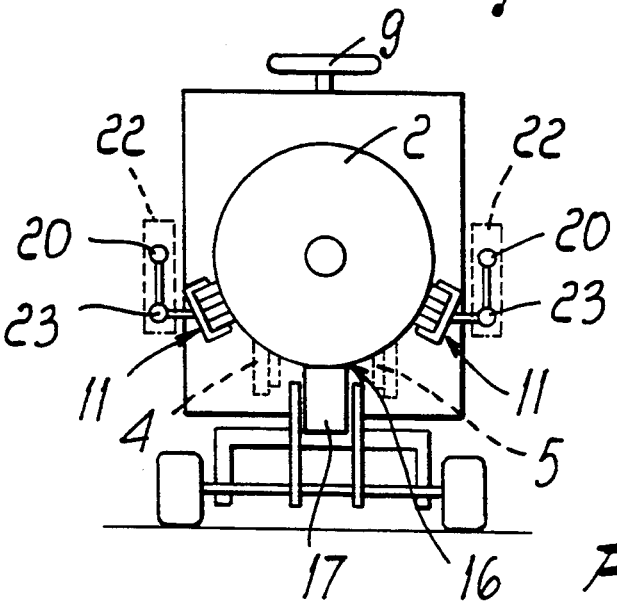
FIG. 2 is a front view of the trolley according to the invention.

With particular reference to the above figures, the reference numeral 1 designates a trolley for loading rolls 2 of band-like material which is part of a device 3 for feeding a packaging machine, which is only partially illustrated in the drawing since it is known. Preferably, the feeder device 3 is of the type described in Italian patent application no. 3461 A/90.

The feeder device 3 has fixed means 4 for the static support of a row of rolls 2 and means 5 for lifting and moving forward said row of rolls; in particular, the fixed supporting means 4 are constituted by a pair of horizontal and mutually parallel straight beams, and the lifting and advancement means 5 are constituted by a pair of bars which are parallel to the beams 4 and are arranged between them.

The bars 5 can be actuated along a closed path which is defined by at least four successive positions, respectively an idle position, a position for lifting the rolls 2, a position for their transfer and a position for their release.

The trolley 1 is constituted by a chassis 6 which is mounted on pairs of wheels 7 and 8, respectively front and rear wheels. The rear wheels 8 can conveniently be steered by actuating an appropriate handlebar 9 which is connected to the axis of the wheels 8 by means of adapted transmission means 10.

The trolley 1 is provided with means 11 for supporting a plurality of rolls 2 arranged in a series side by side so as to form a row of rolls with a substantially cylindrical configuration, generally designated by the reference numeral 12.

Figure 3:
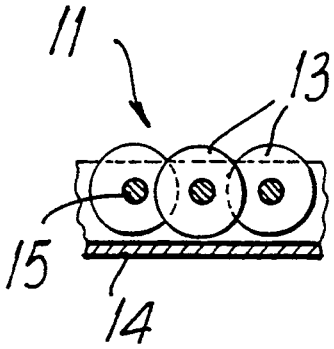
FIG. 3 is an enlarged-scale view of a detail of the roll supporting means.

The means 11 for supporting the row 12 of rolls 2 are constituted by a pair of devices with rollers 13 which are rotatably supported, by a pair of section bar elements 14 which are arranged horizontally and mutually parallel on the sides of the chassis 6; the rollers 13 have axes 15 arranged on planes which are parallel to corresponding planes which are symmetrically tangent to the rolls 2. As can be seen in detail in the enlarged-scale detail of FIG. 3, the rollers 13 are preferably mounted in pairs on the respective axes 15 and are arranged so that they are offset along the longitudinal axis, said pairs being so movable close together without mutual interference.

At the longitudinally median plane, the trolley 1 has transfer means 16 which can move the row 12 of rolls 2 along a direction which is axial with respect to said rolls.

The transfer means 16 are constituted by a conveyor belt 17 which winds around a pair of wheels 18 and 19, respectively a front and a rear wheel, which are rotatably supported by the chassis 6. The row 12 of rolls 2 rests on the upper portion of said conveyor belt 17. In practice, the devices with rollers 13 and the conveyor belt 17 form a sort of cradle on which the row 12 of rolls 2 is supported from three direction so that it can move axially. Naturally it is possible, as an alternative, to form said cradle with a pair of conveyor belts which act at the sides of the trolley and with a roller device arranged at a median position below said belts.

The conveyor belt 17 can be actuated, during transfer, by means of an independent power source, for example an electric battery carried by the trolley 1, or alternatively by drawing the required power from the feeder device 3. For this purpose, the trolley 1 is provided, on the sides and toward the front, with electrical connection means 20 which are constituted by a pair of pins which are adapted to engage corresponding seats 21 defined in respective complementarily shaped elements 22 which are rigidly coupled to the feeder device 3.

At the sides of the supporting devices 11 with rollers 13, the trolley 1 has means 23 for centering and locking with respect to the feeder device 3; said means are constituted by a pair of longitudinal rods 23 mounted along the sides of the chassis 6 and adapted to engage corresponding seats 24 defined in the complementarily shaped elements 22.

The seats 21 and 24 of the complementarily shaped elements 22 respectively have the shape of a vertical slot, so as to facilitate the coupling of the corresponding complementarily shaped means 20 and 23 even in the presence of an imperfect vertical alignment between the trolley 1 and the feeder device 3. A similar function could naturally be performed by equipping the feeder device 3 with protruding means suitable to engage complementarily shaped seats defined on the trolley.

The trolley 1 is furthermore frontally provided with an actuation element 25, for example a jack, which is adapted to raise the chassis 6 if said trolley, due to the characteristics of the floor, is at a lower level than the feeder device 3. It is obvious that in this manner such actuation element 25 and the above-mentioned longitudinal rods 23 provide a three-point rigid and highly efficient centering of the trolley with respect to the feeding device.

The operation of the described trolley is as follows.

The trolley 1, supporting the rolls 2 to be loaded, is moved toward the feeder device 3 of the packaging machine, so as to insert the front end of the transfer means 16 between the supporting means 4 and the lifting and advancement means of the device 3, as shown by the broken lines 11*a* in FIG. 1. The feeder device 3 is provided with means for detecting the absence of the rolls 2.

During this approach, the rods 23 for centering and locking the trolley 1 engage the complementary seats 24 of the feeder device 3, so as to define the correct axial datum line between said trolley and said feeder device. Means are provided for sensing the successful coupling of the trolley 1 to the feeder device 3; said sensor means, not shown, are activated for example by the coupling of the rods 23 in the complementarily shaped seats 24.

It should be noted that for their transfer to the feeder device 3 the rolls 2 must be supported by the devices 11 with rollers 13 and by the belt 17 at a slightly higher level than the resting surface defined by the supporting means 4 and by the means 5 for lifting the device 3; said lifting means 5 are in the lowered idle position during this step. This allows to insert the first rolls 2 of the row 12 to be transferred onto said means 4 and 5 of the feeder device 3, as indicated by the broken lines 12*a* in FIG. 1.

The complementarily shaped seats 24 are provided with suitable locking means, not shown, which are adapted to retain the trolley 1 in the loading position, to avoid its separation for example if the floor is sloping.

The movement of the trolley 1 toward the feeder device 3 produces the engagement of the electrical connection means 20 in the corresponding complementarily shaped seats 21, thus allowing to actuate the means 16 for the transfer of the rolls 2.

It should be noted that the electrical connection means 20 and the centering and locking means 23 are arranged on the sides of the trolley 1, so that they do not hinder the movement of the rolls 2. Said means 20 and 23 are furthermore visible to the operator assigned to the handling of the trolley 1, so as to facilitate their coupling in the complementarily shaped elements 22.

To conclude, the described trolley allows to automatically load a row of rolls of band-like material in a device for feeding a packaging machine.

In the illustrated case, the magazine of the rolls to be used is aligned with the axis for transfer of the rolls carried by the trolley.

However, it is possible to provide for the use of the trolley also to load devices wherein the reserve magazine of the rolls to be used is arranged in an upper region of the packaging machine, as shown and disclosed in U.S. Ser. No. 07/706 533 filed May 28, 1991.

The invention thus conceived is susceptible to numerous modifications and variations, all of which are within the scope of the inventive concept. All the details may furthermore be replaced with other technically equivalent elements.

In practice, the materials employed, as well as the dimensions, may be any according to the requirements.

We claim:

1. Trolley for loading rolls into a device for feeding a packaging machine, said trolley comprising:

a chassis having a front end, a rear end and parallel longitudinal sides and being movable in at least a longitudinal direction thereof;

means for steering said chassis provided at said rear end thereof;

means for raising said chassis provided at said front end thereof;

means for supporting a plurality of rolls arranged side by side so as to form a row of rolls with a substantially cylindrical configuration, said row of rolls having an axis extending parallel to said longitudinal sides of said chassis, said supporting means being mounted on said chassis and extending from said front end to said rear end thereof;

transfer means adapted for moving said row of rolls along said axis thereof, said transfer means being mounted on said chassis and extending from said front end to said rear end thereof;

means for centering and locking said trolley with respect to said device for feeding a packaging machine, said means being provided at said front end of said chassis and at said sides thereof;

electrical connection means being provided at said front end of said chassis and adapted to engage corresponding seats provided on said feeding device for drawing electric power for actuating said transfer means;

wherein said raising means and said means for centering and locking said trolley with centering thereby securing a correct axial datum line between said trolley and said feeding device.

2. Trolley according to claim 1 wherein said means for steering said chassis comprises a handlebar which is connected to an axis of a pair of wheels mounted at the said rear end of said chassis.

3. Trolley according to claim 1 wherein said means for supporting said row of rolls is constituted by at least one device mounted on said chassis along a plane being tangent to said row of rolls along a direction being parallel to said longitudinal sides, said at least one device comprising at least a section bar element and rollers being mounted on said section bar element in an offset manner, whereby said rolls are movable close together without mutual interference.

4. Trolley according to claim 3 wherein said means for supporting said row of rolls is constituted by a pair of devices each comprising a section bar element, said devices being symmetrically mounted along a respective longitudinal side of said chassis.

5. Trolley according to claim 1 wherein said transfer means comprises at least one conveyor belt mounted on said chassis and extending from said front end to said rear end thereof and being actuatable for transferring said row of rolls along said longitudinal direction.

6. Trolley according to claim 1 wherein said means for centering and locking said trolley with respect to said feeding device comprises a pair of rods mounted along said longitudinal sides of said chassis and adapted to engage corresponding seats defined in said feeding device.

7. Trolley according to claim 1 wherein said raising means comprises a jack mounted at said front end of said chassis.

8. Trolley according to claim 1 wherein said electrical connection means comprises a pair of pins, one pin provided at each side of the front end of said chassis, said pins being adapted to engage corresponding seats provided on said feeding device.

9. Trolley according to claim 1 wherein said transfer means and said supporting means are mounted on said chassis so as to support said row of rolls from three directions in a cradle-like manner, whereby said row of rolls is movable along said axis thereof.

10. Trolley for loading rolls into a feeding device of a packaging machine, said trolley comprising:

a chassis having a front end, a rear end and parallel longitudinal sides and being movable in at least a longitudinal direction thereof;

means for raising said chassis provided at said front end thereof;

means for supporting a plurality of rolls arranged side by side so as to form a row of rolls with a substantially cylindrical configuration, said row of rolls having an axis extending parallel to said longitudinal sides of said chassis, said supporting means being mounted on said chassis and extending from said front end to said rear end thereof;

transfer means adapted for moving said row of rolls along said axis thereof, said transfer means being mounted on said chassis and extending from said front end to said rear end thereof;

means for centering and locking said trolley with respect to said device for feeding a packaging machine;

wherein said raising means and said means for centering and locking said trolley with respect to said feeding device provide a three-points centering thereby securing a correct axial datum line between said trolley and said feeding device.

11. Trolley according to claim 10 wherein said means for supporting said row of rolls is constituted by at least one device mounted on said chassis along a plane being tangent to said row of rolls along a direction being parallel to said longitudinal sides, said at least one device comprising at lest a section bar element and rollers being mounted on said section bar element in an offset manner, whereby said rolls are movable close together without mutual interference.

12. Trolley according to claim 10 wherein said means for supporting said row of rolls is constituted by a pair of devices each comprising a section bar element, said devices being symmetrically mounted along a respective longitudinal side of said chassis.

13. Trolley according to claim 10 wherein said transfer means comprises at least one conveyor belt mounted on said chassis and extending from said front end to said rear end thereof and being actuatable for transferring said row of rolls along said longitudinal direction.

14. Trolley according to claim 10 wherein said means for centering and locking said trolley with respect to said feeding device comprises a pair of rods mounted along said longitudinal sides of said chassis and adapted to engage corresponding seats defined in said feeding device.

15. Trolley according to claim 10 wherein said raising means comprises a jack mounted at said front end of said chassis.

16. Trolley according to claim 10 wherein said transfer means and said supporting means are mounted on said chassis so as to support said row of rolls from three directions in a cradle-like manner, whereby said row of rolls is movable along said axis thereof.

17. Trolley for loading rolls into a feeding device of a packaging machine, said trolley comprising:

a chassis having a front end, a rear end and parallel longitudinal sides and being movable in at least a longitudinal direction thereof;

means for raising said chassis provided at said front end thereof; means for supporting a plurality of rolls arranged side by side so as to form a row of rolls with a substantially cylindrical configuration, said row of rolls having an axis extending parallel to said longitudinal sides of said chassis, said supporting means being mounted on said chassis and extending from said front end to said rear end there;

transfer means adapted for moving said row of rolls along said axis thereof, said transfer means being mounted on said chassis and extending from said front end to said rear end thereof;

means for centering and locking said trolley with respect to said device for feeding a packaging machine, said means being provided at said front end of said chassis and at said sides thereof;

wherein said raising means and said means for centering and locking said trolley with respect to said feeding device provide a three-points centering thereby securing a correct axial datum line between said trolley and said feeding device, and said transfer means and said means for centering and locking said trolley with respect to said feeding device are mounted on said chassis so as to support said row of rolls from three directions in a cradle-like manner, whereby said row of rolls is movable along said axis thereof for transferring said rolls forming said row in said feeding device upon inserting a front end of said transfer means in said feeding device.

18. Trolley according to claim 17, wherein said chassis comprises steering means, including a handlebar, said handlebar being connected to an axis supporting a pair of wheels, said pair of wheels being mounted at the said rear end of said chassis.

19. Trolley according to claim 17 wherein said means for supporting said row of rolls is constituted by at lest one device mounted on said chassis along a plane being tangent to said row of rolls along a direction being parallel to said longitudinal sides, said at least one device comprising at least a section bar element and rollers being mounted on said section bar element in an offset manner, whereby said rolls are movable close together without mutual interference.

20. Trolley according to claim 19 wherein said means for supporting said row of rolls is constituted by a pair of devices each comprising a said section bar element, said devices being symmetrically mounted along a respective longitudinal side of said chassis.

21. Trolley according to claim 17 wherein said transfer means comprises at least one conveyor belt mounted on said chassis and extending from said front end to said rear end thereof and being actuatable for transferring said row of rolls along said longitudinal direction.

22. Trolley according to claim 17 wherein said means for centering and locking said trolley with respect to said feeding device comprises a pair of rods mounted along said longitudinal sides of said chassis and adapted to engage corresponding seats defined in said feeding device.

23. Trolley according to claim 17 wherein said raising means comprises a jack mounted at said front end of said chassis.

24. Trolley according to claim 17 further comprising electrical connection means being mounted at said front end of said chassis and adapted to engage corresponding seats provided on said feeding device wherein said electrical connection means comprises a pair of pins, one pin provided at each side of the front end of said chassis, said pins being adapted to engage corresponding seats provided on said feeding device for drawing electric power for actuating said transfer means.

* * * * *